United States Patent [19]

Michael

[11] 3,990,654

[45] Nov. 9, 1976

[54] GARBAGE CAN HOLDING MEANS

[76] Inventor: Sherman M. Michael, 1453 Ranger Drive, Southaven, Miss. 38671

[22] Filed: Nov. 3, 1975

[21] Appl. No.: 627,853

[52] U.S. Cl. ..... 248/311.1; 211/71; 248/DIG. 7

[51] Int. Cl.[2] ..... A47G 29/00

[58] Field of Search ..... 248/223, 311, 313, DIG. 7; 211/71, 88, 86

[56] References Cited

UNITED STATES PATENTS

| | | | |
|---|---|---|---|
| 1,669,782 | 5/1928 | Risser | 248/DIG. 3 |
| 1,873,297 | 8/1932 | Davenport | 248/311 R |
| 3,007,664 | 11/1961 | Fairbanks et al. | 248/311 R X |
| 3,091,342 | 5/1963 | Crump | 248/DIG. 7 |
| 3,184,198 | 5/1965 | Morgan | 248/311 R X |
| 3,892,315 | 7/1975 | Johnson | 211/71 |

*Primary Examiner*—J. Franklin Foss
*Attorney, Agent, or Firm*—John R. Walker, III

[57] ABSTRACT

A holding device for detachably holding a garbage can to a link fence at any desired height. The garbage can is firmly held to the holding device by a wedge-like portion of the holding device which extends between a handle of the garbage can and the garbage can. A projecting member of the holding device projects through any one link of the link fence and coacts with the upper and lower parts of that link to bind the holding device thereto. Radially extending arm members of the holding device coact with the link fence to maintain the holding device in a substantially parallel position to the link fence. The garbage can is partially encircled by a portion of the holding device so as to prevent any wavering of the garbage can while it is secured to the holding device.

7 Claims, 4 Drawing Figures

GARBAGE CAN HOLDING MEANS

BACKGROUND OF THE INVENTION

Field of the Invention

This invention relates generally to means for supporting containers and more specifically to means for holding garbage cans to link fences.

SUMMARY OF THE INVENTION

The present invention is directed towards overcoming the problems and disadvantages of prior means for holding containers to link fences. The concept of the present invention is to provide a container holding means having a securing means for securing a container to the holding means and having a lock means for detachably locking the holding means to a link fence at any desired height. The lock means includes a projecting member for projecting through any one link of the link fence. The projecting member includes a portion for coacting with part of the link through which the projecting member projects to bind the holding means thereto. Preferably, the projecting member includes an upwardly extending portion for coacting with the upper part of the link through which the projecting member projects to bind the holding means thereto and includes a downwardly extending portion for coacting with the lower part of the link through which the projecting member projects to bind the holding means thereto. The securing means preferably includes a wedge-like portion for extending between the container and a handle of the container to firmly secure the container to the holding means.

DESCRIPTION OF THE PREFERRED EMBODIMENT

Figure 1:
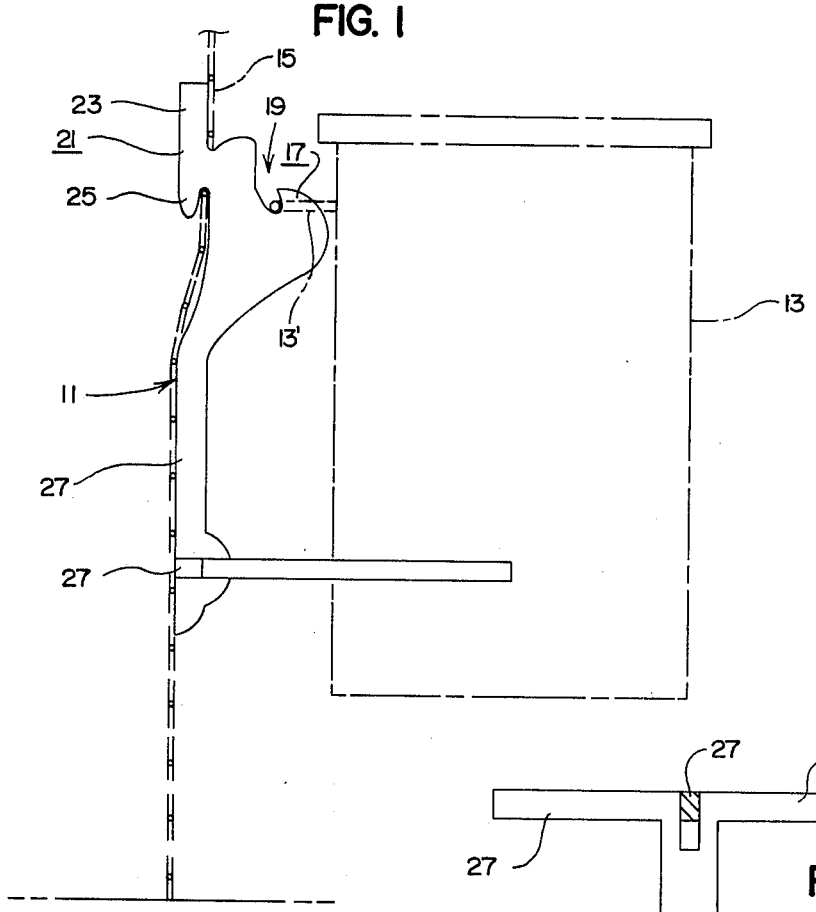
FIG. 1 is a side elevational view of the holding means of the present invention with a container and a link fence shown in phantom lines.

The holding means 11 of the present invention is used to detachably hold a container such as a garbage can 13 to a link fence 15 at any desired height on the link fence 15. The holding means 11 includes, in general, securing means for securing the garbage can 13 to the holding means 11 and lock means for detachably locking the holding means 11 to the link fence 15 at any desired height thereon.

The securing means preferably includes a wedge-like portion 17 for extending between the garbage can 13 and a handle 13' of the garbage can 13 to firmly secure the garbage can 13 to the holding means 11. The wedge-like portion 17 preferably includes a notch 19 for receiving the handle 13' of the garbage can to thereby allow the wedge-like portion 17 to hook around the handle 13' (see FIG. 1).

Figure 4:
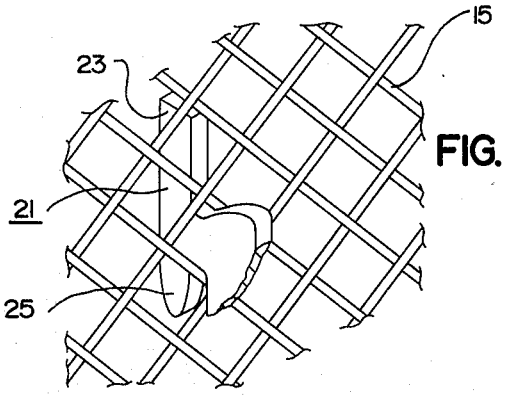
FIG. 4 is a perspective view of a portion of the holding means of the present invention shown attached to a link fence.

The lock means includes a projecting member 21 for projecting through any one link of the link fence 15 (see FIGS. 1 and 4). The projecting member 21 includes a portion for coacting with part of the link through which it projects to thereby bind the holding means 11 to the link fence 15. More specifically, the projecting member 21 preferably includes an upwardly extending portion 23 for coacting with the upper part of the link through which the projecting member projects to bind the holding means 11 thereto and includes a downwardly extending portion 25 for coacting with the lower part of the link through which the projecting member 21 projects to bind the holding means 11 thereto.

The holding means 11 preferably includes prop means for maintaining the holding means 11 in a substantially parallel position to the link fence 15 while the holding means 11 is locked to the link fence 15. The prop means preferably includes a plurality of radially extending arm members 27. The arm members 27 press against the link fence 15 when the holding means 11 is locked to the link fence 15 to prevent the holding means 11 from pressing into any one portion of the link fence 15 thereby spreading the weight of the holding means 11 over the link fence 15 and allowing the holding means 11 to remain in a substantially parallel position to the link fence 15.

Figure 3:
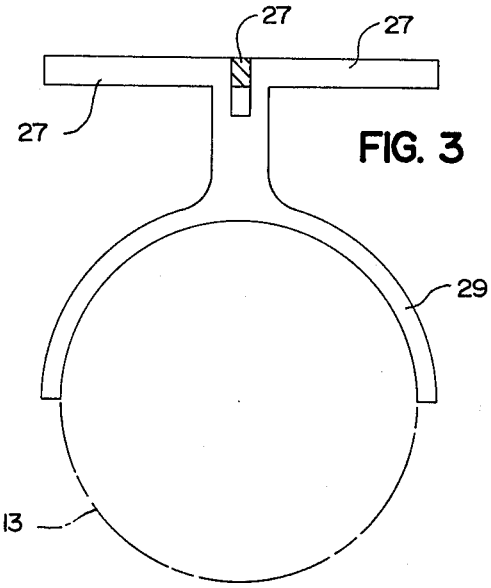
FIG. 3 is a sectional view of the holding means of the present invention as taken on line III—III of FIG. 2 with a container shown in phantom lines.
Figure 2:
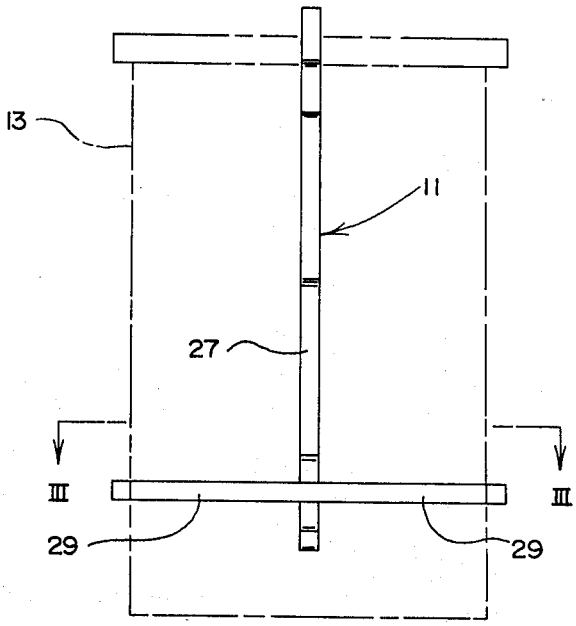
FIG. 2 is a front elevational view of the holding means of the present invention with a container shown in phantom lines.

The holding means 11 preferably includes stabilizing means for holding the garbage can 13 steady while it is secured to the holding means 11 by the securing means. The stabilizing means preferably includes a member 29 for partially encircling the garbage can 13 to prevent any wavering of the garbage can 13 while it is secured to the holding means 11. The shape of the member 29 is preferably that of a portion of the outside of the garbage can 13 (see FIG. 3). Thus, the shape of the member 29 will usually be arcuate since the outsides of most garbage cans 13 are arcuate.

The use of the holding means 11 of the present invention is quite simple. To attach the holding means 11 to the link fence 15, the projecting member 21 is merely passed through any one link of the link fence 15 determined by the desired height of the holding means 11. After the projecting member 21 is passed through the desired link, the holding means 11 is allowed to pivot downwardly until the plurality of radially extending arm members 27 engage the link fence 15 to maintain the holding means 11 in a substantially parallel position to the link fence 15. In this position, the upwardly and downwardly extending portion 23, 25 of the projecting member 21 binds the holding means 11 to the link fence 15. Next, the handle 13' of the garbage can 13 is passed over the wedge-like portion 17 to cause the garbage can 13 to be firmly secured to the holding means 11. In this position, the body of the garbage can 13 is partially encircled by the member 29 so that the garbage can 13 is held steady.

As thus constructed and used, the present invention provides a simple and inexpensive means for holding a garbage can to a link fence which allows the height of the garbage can to be adjusted.

Although the invention has been described and illustrated with respect to a preferred embodiment thereof, it is not to be so limited since changes and modifications may be made therein which are within the full intended scope of the invention.

I claim:

1. Holding means for detachably holding a container to a link fence at any desired height, said holding means comprising securing means for securing the container to said holding means, and lock means for detachably locking said holding means to the link fence at any desired height, said lock means including a projecting member for projecting through any one link of the link fence and to bind said holding means to the link fence, said projecting member including an upwardly extending portion for coacting with the upper part of the link through which said projecting member projects to bind said holding means thereto and a downwardly extending portion for coacting with the lower part of the link through which said projecting member projects to bind said holding means thereto.

2. The container holding means of claim 1 in which said securing means includes a wedge-like portion for extending between the container and a handle of the container to firmly secure the container to said holding means.

3. The container holding means of claim 2 in which is included prop means for maintaining said holding means in a substantially parallel position to the link fence while said holding means is locked to the link fence.

4. The container holding means of claim 3 in which said prop means includes a plurality of radially extending arm members for coacting with the link fence to maintain said holding means in a substantially parallel position to the link fence.

5. The container holding means of claim 4 in which is included stabilizing means for holding the container steady while it is secured to said holding means by said securing means.

6. The container holding means of claim 5 in which said stabilizing means includes a member for partially encircling the container to prevent any wavering of the garbage can while it is secured to said holding means by said securing means.

7. Garbage can holding means for detachably holding a garbage can to a link fence at any desired height, said holding means comprising:

a. securing means for securing the garbage can to said holding means, said securing means including a wedge-like portion for extending between the garbage can and a handle of the garbage can to firmly secure the garbage can to said holding means;

b. stabilizing means for holding the garbage can steady as it is secured to said holding means by said securing means, said stabilizing means including a member for partially encircling the garbage can to prevent any wavering of the garbage can while it is secured to said holding means by said securing means;

c. lock means for detachably locking said holding means to the link fence at any desired height, said lock means including a projecting portion for projecting through any one link of the link fence, said projecting portion having an upwardly extending portion for coacting with the upper part of the link through which said projecting portion projects to bind said holding means thereto and having a downwardly extending portion for coacting with the lower part of the link through which said projecting portion projects to bind said holding means thereto; and d. prop means for maintaining said holding means in a substantially parallel position to the link fence while said holding means is locked to the link fence, said prop means including a plurality of radially extending arm members for coacting with the link fence to maintain said holding means in a substantially parallel position to the link fence.

* * * * *